United States Patent [19]

Ahoste

[11] Patent Number: 4,970,950

[45] Date of Patent: Nov. 20, 1990

[54] BALING PRESS

[76] Inventor: Unto Ahoste, Tuulikinkatu 2 C 24, SF-48700 Kyminlinna, Finland

[21] Appl. No.: 211,860

[22] PCT Filed: Dec. 12, 1986

[86] PCT No.: PCT/FI86/00149

§ 371 Date: Jul. 28, 1988

§ 102(e) Date: Jul. 28, 1988

[87] PCT Pub. No.: WO87/03535

PCT Pub. Date: Jun. 18, 1987

[30] Foreign Application Priority Data

Dec. 12, 1985 [FI] Finland ..... 854932

[51] Int. Cl.[5] ..... B30B 1/34

[52] U.S. Cl. ..... 100/269 R; 100/214

[58] Field of Search ..... 100/46, 214, 269 R, 100/269 B, 257, 258 R, 258 A, 915; 72/386, 389, 455, 456, 453.09, 453.12; 425/406, 408

[56] References Cited

U.S. PATENT DOCUMENTS

| | | | |
|---|---|---|---|
| 80,877 | 8/1896 | Rawson | 100/269 R |
| 3,920,364 | 11/1975 | Cadogan-Rawlinson et al. | 100/269 R X |
| 4,203,359 | 5/1980 | Baltschun | 100/269 R X |

FOREIGN PATENT DOCUMENTS

| | | | |
|---|---|---|---|
| 2043826 | 3/1972 | Fed. Rep. of Germany | 100/269 R |
| 616161 | 7/1978 | U.S.S.R. | 100/269 R |
| 1454159 | 10/1976 | United Kingdom | 100/269 R |

*Primary Examiner*—Harvey C. Hornsby
*Assistant Examiner*—Stephen F. Gerrity
*Attorney, Agent, or Firm*—Merchant, Gould, Smith, Edell, Welter & Schmidt

[57] ABSTRACT

A baling press, comprising two substantially parallel press plates (1, 2) and at least four substantially parallel hydraulic pull cylinders (4, 5, 6, 7) which have been disposed to connect the press plates (1, 2) with each other and to pull them against each other.

2 Claims, 2 Drawing Sheets

BALING PRESS

BACKGROUND OF THE INVENTION

The present invention concerns a baling press comprising two substantially parallel press plates and a force means for pressing these press plates against each other. In particular, the invention concerns fast and high-capacity baling presses to be used in baling cellulose.

Cellulose baling presses in present use are mainly based on one specific construction principle. The press comprises a horizontal, lower press plate which is stationary in relation to the base and an upper bracing plate fixedly attached thereto, above it, with the aid of posts or another joining structure. Between the bracing plates has been disposed a, likewise horizontal, movable press plate, which has been provided with a powerful hydraulic cylinder, braced against the bracing plate, for moving it in relation to the lower press plate and pressing it thereagainst, supported by guides or equivalent. Presses of this kind are intended in the first place for 200-kg bales, and the pressing force of the presses is on the order of 1000 tons.

In the press just described, concentration of the resistance to pressing constitutes a drawback. If the resistance to pressing, i.e., the bale which is being pressed is not constantly positioned in the center of the press, the centrally disposed hydraulic cylinder gives rise to an eccentric moment, which may cause breakage of the press. It should be noted that in practice the resistance to pressing may deviate from centered position even by several tens of centimetres; the consequence has in fact been instances in which the press was broken.

When the production rate in a cellulose mill exceeds 1000 tons per day, it becomes necessary to press one bale more frequently than every 20 seconds. This has necessitated dividing the production between two separate pressing and baling lines. The normal consumption of baling wire in a larger cellulose mill like this involves costs even in the neighbourhood of FIM 8000 per day, or FIM 3 million annually. To this must be added the costs for wire required in tying up large units when several bales are combined to make large units e.g. of 1600 kg each.

Furthermore, the 200-kg bales produced with existing baling presses are unsatisfactory because the baling wires running crosswise have to be manually removed in the paper mill. The bales are moreover of different sizes, and even otherwise defective, that is: there are internal gaps in the large-size unit, which cause soiling and a risk of bale disintgration and toppling.

Baling presses in present use are unable to press bales larger than those containing 200 kg. In endeavours to develop bigger and more efficient presses for larger bales and for increased pressing force, difficulties of structural designing have been encountered. However, press constructions of prior art are not applicable in higher capacity presses: the structure simply fails in lack of strength.

Developing higher capacity baling presses is desirable in order to eliminate the drawbacks that have been mentioned and also in order to reduce the transport costs. Cellulose transporting costs, e.g. on the order of FIM 160 to 280 per ton, are essentially directly proportional to the bale volume. Thus for instance increasing the efficiency of pressing by 10% would result in a corresponding reduction of transport costs.

SUMMARY OF THE INVENTION

The object of the present invention is to eliminate the drawbacks set forth in the foregoing. In particular, the object of the invention is to provide a new type of baling press design which can be applied in more efficient presses, particularly for producing larger bales.

It is furthermore an object of the invention to provide a new type of baling press in which symmetric placement of the bale in the center of the press is not critical.

It is furthermore an object of the invention to provide a new type of baling press in the use of which the consumption of baling wire is significantly less than before.

It is furthermore an object of the invention to provide a baling press by using which the bales can be made uniform and mainly faultless, and considerably bigger than previous bales.

It is furthermore an object of the invention to provide a baling press by using which the cellulose bale can be pressed to significantly smaller volume than before so that the bale handling and freight costs are reduced.

It is furthermore an object of the invention to provide a baling press which is simpler of its construction than presses of prior art and more reliable in service than these.

Regarding the characteristic features of the invention reference is made to the Claims.

The invention is based on a baling press design wherein two substantially parallel press plates have been joined with each other by the aid of at least four, subastantially parallel, hydraulic pull cylinders so that the plates can be pressed against each other with the aid of said cylinders.

The press plates have then been appropriately disposed one above the other, substantially horizontally, and they constitute the upper and lower press plates. The upper press plate is then appropriately supported with the aid of supporting legs only, and the lower plate has been suspended from the upper plate by meditation of the pull cylinders. Pressing will then take place with the aid of said pull cylinders; the press opens, i.e., the lower plate descends by effect of its weight when the pressure in the cylinders is released.

In an alternative embodiment the lower press plate may, is desired, be supported on the base with the aid of supporting legs, in which case pressing takes place in the manner just described, by mediation of the pull cylinders. Then, however, the upper plate has to be provided with a lifting means for opening the press. The lifting means may consist of a hydraulic lifting means, or the pull cylinders of the press, that is the power cylinders, may be designed to be double-acting for moving the plates away from each other with the aid of the cylinders.

For centering the pressing force, and for avoidance of asymmetric loads on the pull cylinders, these cylinders may be attached to one of the two press plates, or advantageously to both press plates, with the aid of ball joints. Further, for avoidance of torsion, the pull cylinders are advantageously synchronized, e.g. hydraulically or in another way. Furthermore, the pull cylinders, e.g. 4, 6, 8 or several cylinders, are advantageously placed symmetrically around the pressing areas of the press plates, e.g. in square or rectangular configuration as viewed in a section perpendicular to the cylinders.

The baling press of the invention can be manufactured to have a pressing force of such magnitude and with such capacity as is desired, by employing a number of press cylinders consistent with the desired pressing force.

By virtue of th present invention, stresses caused by torsion are avoided in the press, that is, the press that has been developed is appropriate to be used even in the event of asymmetric load, i.e., when the bale that has to be pressed assumes a position which is asymmetric in relation to the power cylinders, because during the pressing motion in the press only tension stresses acting on the cylinders and bending stresses acting on the plates are produced. The deformations caused by these stresses, and other detriments, are easily counteracted by means of adequate strengths and material thicknesses. Hereby the press is appropriate to be constructed to press e.g. a twofold, fourfold, eightfold or even bigger bale, compared with the present 200-kg bale. The baling capacity will then increase substantially since a bigger bale does not necessarily imply longer pressing time than a smaller bale. On the other hand, it is possible to lengthen the pressing time as the capacity of the press increases, without incurring any problems on the baling and packaging lines, whereby the bale can be compressed to smaller volume, which is conducive to substantial reduction of packaging and transport costs.

The increased baling capacity achieved with the press of the invention obviates the need of a parallel packaging line, even in a larger pulp mill, whereby space economy is achieved. Moreover, handling the cellulose in larger bales, and tying the bales up in larger units as a rule, contributes substantially to reduced space requirements. Furthermore, the consumption of baling wire is substiantially reduced, compared with previous conditions. The bales will also be uniform and, owing to the increased pressing force, faultless in shape, whereby the bales will hold together without breaking up and they will not entail any risk of toppling.

Briefly observed, the baling press of the invention affords significant savings with regards to bale pressing, bale tying, handling and transport. The baling press of the invention is furthermore simpler in construction and more reliable in use than presses of prior art.

BRIEF DESCRIPTION OF THE DRAWINGS

The invention is described in detail in the following with the aid of embodiment examples, referring to the attached drawings, wherein.

DESCRIPTION OF THE PREFERRED EMBODIMENT

Figure 1:
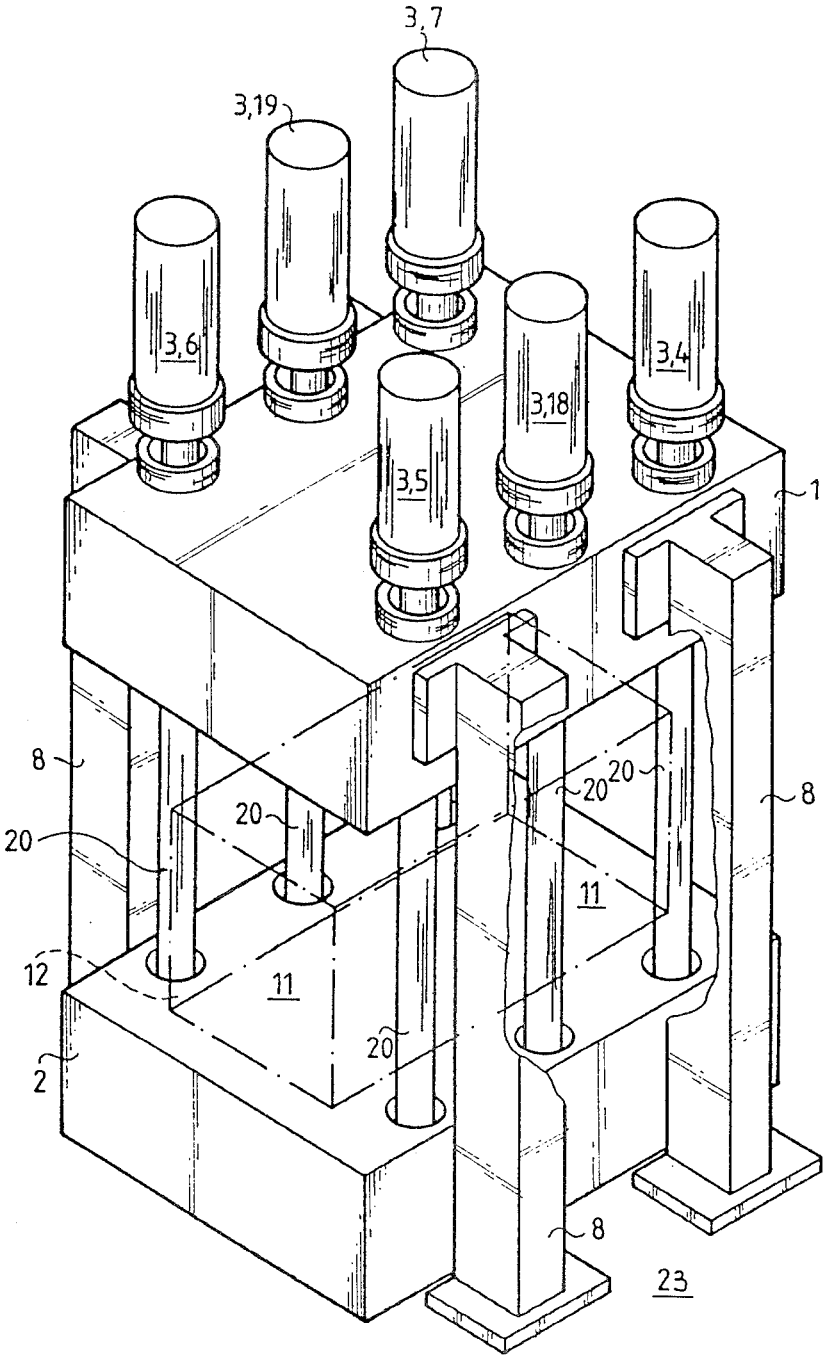
FIG. 1 presents, viewed from obliquely above, a baling press according to the invention.

In FIG. 1 is seen a baling press, comprising two substantially parallel press plates 1, 2 and a force means 3 for pressing said press plates against each other. As taught by the invention, the force means 3 comprises at least four, in the embodiment here depicted six, substantially parallel hydraulic pull cylinders 4, 5, 6, 7, 18, 19, which have been arranged to connect the press plates with each other and to pull them against each other.

In the embodiment depicted, the press plates 1, 2 have been disposed horizontally one above the other, and they constitute the upper press plate 1 and the lower press plate 2. The upper press plate 1 is supported on the base 23 with the aid of four supporting legs 8. The lower press plate 2 is suspended from the upper press plate 1 by means of the pull cylinders 4, 5, 6, 7, 18, 19. The pull cylinders have been placed in rectangular configuration in relation to the press plates so that between the cylinders is left a substantilly rectangularly shaped free pressing zone 11. The press plates 1, 2 are not attached to each other in any way other than by said pull cylinders, i.e., the press plates are free of other mutual connections When the baling press of FIG. 1 begins operation, the pressure is removed from the cylinders 4, 5, 6, 7, 18, 19 (in order to better illustrate the design, the hydraulic tubing has not been depicted), whereby the mass of the lower press plate 2 causes this press plate to descend into the lower position, shown in the figure. The cellulose sheets to be compressed, 12, (indicated with dotted lines in the form of a bale) are thereafter transported onto the lower press plate 2 e.g. with the aid of conventional transporting means (in order to better illustrate the design, not depicted). Next, hydraulic pressure is conducted into the force means 3, that is the said pull cylinders 4, 5, 6, 7, 18, 19, whereby the pull cylinders, that is their piston rods 20, pull the plates against each other, thus pressing the bale between the plates. After desired pressing time, the pressure is released from the cylinders, whereby the lower plate 2 descends into the position of FIG. 1, and the bale is removed and tied up. The pressing time may be e.g. on the order of 10–30 seconds, or longer if desired, e.g. on the order of one or several minutes.

Figure 3:
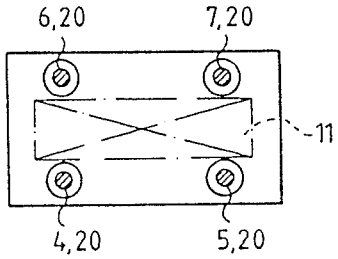
FIG. 3 shows the section along line III—III in FIG. 2.
Figure 2:
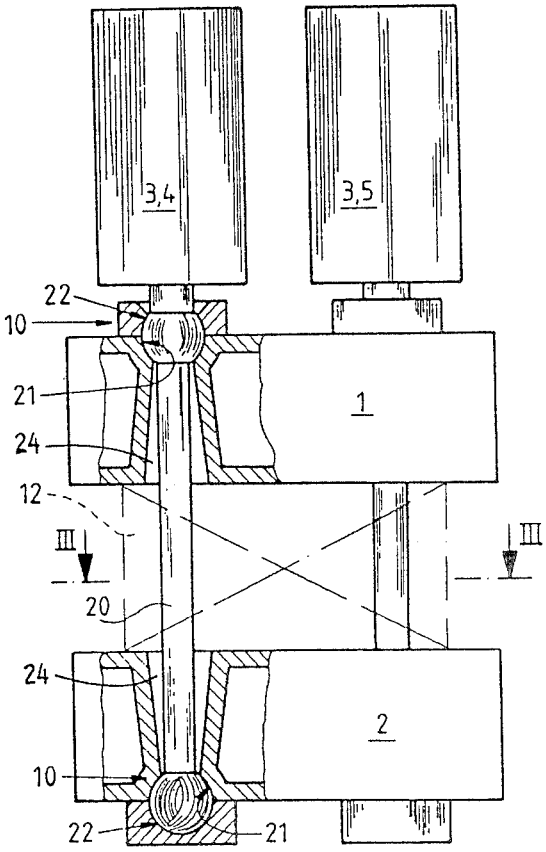
FIG. 2 presents another baling press according to the invention, partly sectioned and viewed from one end, its supporting legs removed.

In FIGS. 2–3 is seen another baling press according to the invention, comprising a force means 3, that is four pull cylinders 4, 5, 6, 7, which connected the horizontal, parallel press plates 1, 2 with each other and which have been disposed to pull these plates against each other. In FIG. 2, the supporting legs attaching the upper press plate 1 to the base (not depicted) have been left out for greater perspicuity of the presentation.

In FIG. 2 is shown, partly sectioned, the attachment of the cylinder 4 to the press plates 1, 2 with the aid of ball joints 10. In the embodiment here depicted, the piston 20 of the cylinder 4 pierces the press plates 1, 2 through passages widening from the ball joints to the pressing surface of the press plate. The outer, that is lower, end of the piston 20 constitutes a spherical supporting surface 22 and it rests againts a spherical supporting surface 21 provided on the lower plate 2. The part of the cylinder 4 adjacent to the piston likewise forms a spherical supporting surfaces 22, which is carried against the spherical supporting surfaces 21 provided on the upper press plate. The spherical surfaces on piston and cylinder and the respective spherical surfaces on the press plates form ball joints, which permit turning on the cylinder in a direction parallel to the plane of the supporting plates.

FIG. 3 shows a section of the press. The piston rods 30 of the cylinder 4, 5, 6, 7 have been placed in rectangular configuration, i.e., symmetrically in relation to the press plate 2. Between the cylinders is left a rectangularly shaped pressing zone 11 for bale pressing.

Figure 4:
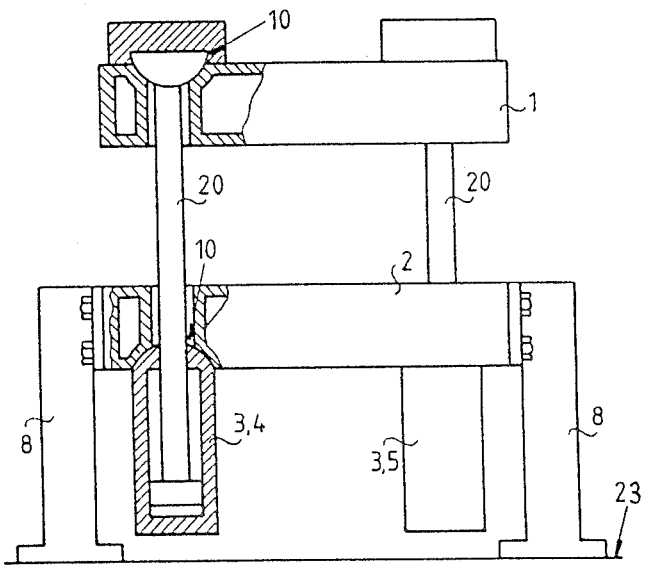
FIG. 4 presents schematically, in elevational view, a third baling press according to the invention.

In FIG. 4 is shematically represented a press equivalent in principle to the presses depicted in FIGS. 1–3, in this press however the lower press plate 2 rest on the base with the aid of supporting legs 8. Moreover, the press comprises a lifting means for raising the upper press plate 1 in relation to the lower plate. In the embodiment here depicted, said lifting means consists of cylinder 4, 5, 6, 7, these cylinders having been made double-acting so that the upper press plate can be lifted with the aid of the cylinders in relation to the lower plate.

The embodiment examples are only meant to illustarate invention, and embodiments of the invention may vary within the scope of the claims stated below.

I claim:

1. A baling press for baling pulp, comprising:

two substantially parallel press plates, having an upper press plate supported on supporting legs disposed above a lower press plate in a substantially parallel plane;

force means for pressing said press plates against each other, said force means having at least four substantially parallel pull cylinders which have been disposed to connect said press plates with each other and to pull said press plates against each other, wherein the press plates are attached to each other by said pull cylinders so that the lower press plate is suspended from the upper press plate by mediation of said pull cylinders, and wherein said pull cylinders are connected to both press plates with ball joints, wherein piston rods of said pull cylinders extend through passages in said press plates to said ball joints and wherein said passages in said press plates widen from the ball joints to a pressing surface of the press plates to provide lateral movement of said piston rods relative to said press plates to avoid torsion and binding in said press.

2. A baling press according to claim 1, whereby said press can accommodate pulp of varying density with less tendency for binding of said press.

* * * * *